US010261472B2

(12) United States Patent
Bernard et al.

(10) Patent No.: US 10,261,472 B2
(45) Date of Patent: Apr. 16, 2019

(54) STRIKING MECHANISM

(71) Applicant: COMPLITIME SA, La Chaux-de-Fonds (CH)

(72) Inventors: David Bernard, Peseux (CH); Florian Corneille, Mathay (FR); Thomas Dietrich, Bôle (CH); Stephen Forsey, Les Brenets (CH)

(73) Assignee: COMPLITIME SA, La Chaux-de-Fonds (CH)

( * ) Notice: Subject to any disclaimer, the term of this patent is extended or adjusted under 35 U.S.C. 154(b) by 0 days.

(21) Appl. No.: 15/509,410

(22) PCT Filed: Sep. 23, 2015

(86) PCT No.: PCT/EP2015/071815
§ 371 (c)(1),
(2) Date: Mar. 7, 2017

(87) PCT Pub. No.: WO2016/046245
PCT Pub. Date: Mar. 31, 2016

(65) Prior Publication Data

US 2017/0277126 A1 Sep. 28, 2017

(30) Foreign Application Priority Data

Sep. 23, 2014 (CH) ..... 1438/14

(51) Int. Cl.
*G04B 21/04* (2006.01)
*G04B 21/12* (2006.01)
(Continued)

(52) U.S. Cl.
CPC ..... *G04B 21/04* (2013.01); *G04B 21/06* (2013.01); *G04B 21/12* (2013.01); *G04B 23/026* (2013.01)

(58) Field of Classification Search
CPC ..... G04B 21/04; G04B 23/026; G04B 21/06; G04B 21/08; G04B 23/025; G04B 23/028; G04B 21/12
See application file for complete search history.

(56) References Cited

U.S. PATENT DOCUMENTS 3,508,350 A * 4/1970 Genin ..... G04B 21/005 368/45
4,036,005 A * 7/1977 Jauch ..... G04B 21/022 368/269

(Continued)

FOREIGN PATENT DOCUMENTS

CH 698019 4/2009
CH 704623 9/2012

*Primary Examiner* — Sean P Kayes
(74) *Attorney, Agent, or Firm* — Duane Morris LLP; Gregory M. Lefkowitz; Jason M. Nolan

(57) ABSTRACT

The invention relates to a striking mechanism, comprising striking hammers, gongs, each being arranged to produce a sound under the action of a hammer associated therewith, actuators for actuating the associated hammer, a striking control device, and at least one striking drive device arranged to engage with the control device. The invention further comprises at least one mechanism for striking multiples of n hours, n≥2, kinematically connected to said striking drive device, said mechanism for striking multiples of n hours being arranged to actuate the hammers to strike the multiples of groups of n hours according to a specific striking when said control device has been actuated.

13 Claims, 10 Drawing Sheets

(51) Int. Cl.
*G04B 21/06* (2006.01)
*G04B 23/02* (2006.01)

(56) References Cited

U.S. PATENT DOCUMENTS

| | | | | |
|---|---|---|---|---|
| 8,374,057 | B2 * | 2/2013 | Journe | G04B 21/12 368/72 |
| 9,292,004 | B2 * | 3/2016 | Raggi | G04B 21/08 |
| 2010/0214884 | A1 | 8/2010 | Corthesy et al. | |
| 2012/0230161 | A1 * | 9/2012 | Goeller | G04B 11/024 368/244 |
| 2012/0230162 | A1 * | 9/2012 | Goeller | G04B 21/12 368/244 |
| 2012/0230163 | A1 * | 9/2012 | Goeller | G04B 19/23 368/267 |
| 2012/0230164 | A1 * | 9/2012 | Goeller | G04B 21/12 368/267 |
| 2012/0230165 | A1 * | 9/2012 | Goeller | G04B 21/12 368/267 |
| 2014/0104994 | A1 * | 4/2014 | Raggi | G04B 21/08 368/243 |

* cited by examiner

STRIKING MECHANISM

CROSS-REFERENCE TO RELATED APPLICATIONS

This application is a § 371 national stage entry of International Application No. PCT/EP2015/071815, filed Sep. 23, 2015, which claims priority to Swiss Patent Application No. 01438/14, filed Sep. 23, 2014, the entire contents of which is incorporated herein by reference.

TECHNICAL FIELD

The present invention relates to the field of mechanical horology. It more particularly relates to a striking mechanism comprising strike-hammers, gongs, each being arranged to produce a sound under the action of the associated hammer, actuators for actuating the associated hammer, a striking control device, and at least one striking driving device arranged to cooperate with said control device.

BACKGROUND OF THE INVENTION

Such timepieces have been known for some time, in particular in the field of so-called complicated watches such as repetition watches or grand strike watches. These watches have more or less complex striking mechanisms aiming to strike on demand or automatically at regular time intervals.

Also known are quarter-repeaters, which strike a low blow for the hours and two blows for each quarter-hours, one low and the other high, five-minute repeaters, which strike the hours, the quarter-hours, and the five minutes in addition to a quarter, and minute-repeaters, which strike the hours, the quarter-hours and the minutes. A grand strike strikes the hours and the quarter-hours.

Also known from patent CH 698 019 is a repetition striking mechanism making it possible to strike the hours, the tens of minutes and the minutes.

However, none of these striking-works make it possible to differentiate the hours before noon from the hours after noon, the striking to indicate 15:00 for example being identical to the striking to indicate 3:00 in the morning.

One aim of the present invention is therefore to resolve these drawbacks, by proposing a striking mechanism making it possible to strike the hours in an original manner, and in particular able to differentiate at least the afternoon hours from the morning hours.

BRIEF DESCRIPTION OF THE INVENTION

To this end, and according to the present invention, a striking mechanism is proposed comprising strike-hammers, gongs, each being arranged to produce a sound under the action of the associated hammer, actuators to actuate the associated hammer, a striking control device, and at least one striking driving device arranged to cooperate with said control device.

According to the invention, said striking mechanism further comprises at least one mechanism for striking multiples of n hours, n being greater than or equal to 2, kinematically connected to said striking driving device, said mechanism for striking multiples of n hours being arranged to actuate hammers to strike the multiples of n-hour groups according to a specific strike when said control device has been actuated. In this context, the term "group" is used according to the following definition from the Larousse dictionary: "each of the durations, successive time ranges, in a given set: distribute the children by age groups". Consequently, "group" is synonymous here with "set", encompassing a predefined series of n hours from among the total number of indicated hours.

According to a first variant embodiment, n may be equal to 10, and the mechanism for striking multiples of n hours is a mechanism for striking tens of hours arranged to actuate hammers to strike the tens of hours at least from the hour equal to 13:00 when said control device has been actuated.

According to another variant embodiment, n may be equal to 10, and the mechanism for striking multiples of n hours is a mechanism for striking tens of hours arranged to actuate hammers to strike the tens of hours at least beginning at the hour equal to 10:00 when the control device has been actuated.

Advantageously, said mechanism for striking tens of hours comprises at least one tens of hours piece kinematically connected to said striking driving device and comprising a tens of hours rack arranged to actuate the hammers to strike the tens of hours and a tens of hours feeler-spindle arranged to cooperate with a tens of hours cam, said tens of hours cam having a periodicity of 24 hours and having at least two steps.

Preferably, the striking mechanism according to the invention further comprises a mechanism for striking units of hours arranged to actuate hammers to strike the units of hours, said mechanism for striking units of hours comprising an units of hours piece kinematically connected to said striking driving device and arranged to actuate the hammers to strike the units of hours, and an units of hours feeler-spindle arranged to cooperate with an units of hours cam, said units of hours cam having a periodicity of 24 hours and having three arms, the first arm comprising nine steps corresponding to units of hours from 01:00 to 09:00, the second arm comprising 10 steps corresponding to the units of hours from 10:00 to 19:00, and the third arm comprising five steps corresponding to the units of hours from 20:00 to 00:00.

Preferably, the striking mechanism according to the invention further comprises a mechanism for striking the quarter-hours arranged to actuate hammers to strike the quarter-hours, said mechanism for striking quarter-hours comprising a quarter-hours piece kinematically connected to said striking driving device and comprising a quarter-hours rack arranged to actuate the hammers to strike the quarter-hours, and a quarter-hours feeler-spindle arranged to cooperate with a quarter-hours cam.

Preferably, the striking mechanism according to the invention further comprises a mechanism for striking the minutes arranged to actuate hammers to strike the minutes, said mechanism for striking the minutes minute comprising a minutes piece kinematically connected to the quarter-hours piece and comprising a minutes rack arranged to actuate the hammers to strike the minutes and a minutes feeler-spindle arranged to cooperate with a minutes cam.

Preferably, the striking driving device comprises a sequencer to time and regulate the lag between the striking of the multiples of n hours, the units of hours, the quarter-hours and the minutes.

According to a first alternative, the striking driving device comprises a single striking driving wheel, the sequencer comprising a driving finger for the multiples of n-hour groups, for example tens of hours, and a driving finger for the quarter-hours carried in an offset manner by said striking driving wheel.

According to another variant, the striking driving device comprises a striking driving wheel for the multiples of n-hour groups, for example tens of hours, and a striking driving wheel for the units of hours, quarter-hours and minutes, the sequencer comprising a differential interposed between said striking driving wheel of the multiples of n-hour groups and the striking driving wheel of the units of hours, quarter-hours and minutes.

The present invention also relates to a timepiece including a striking mechanism as defined above.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Figure 1:
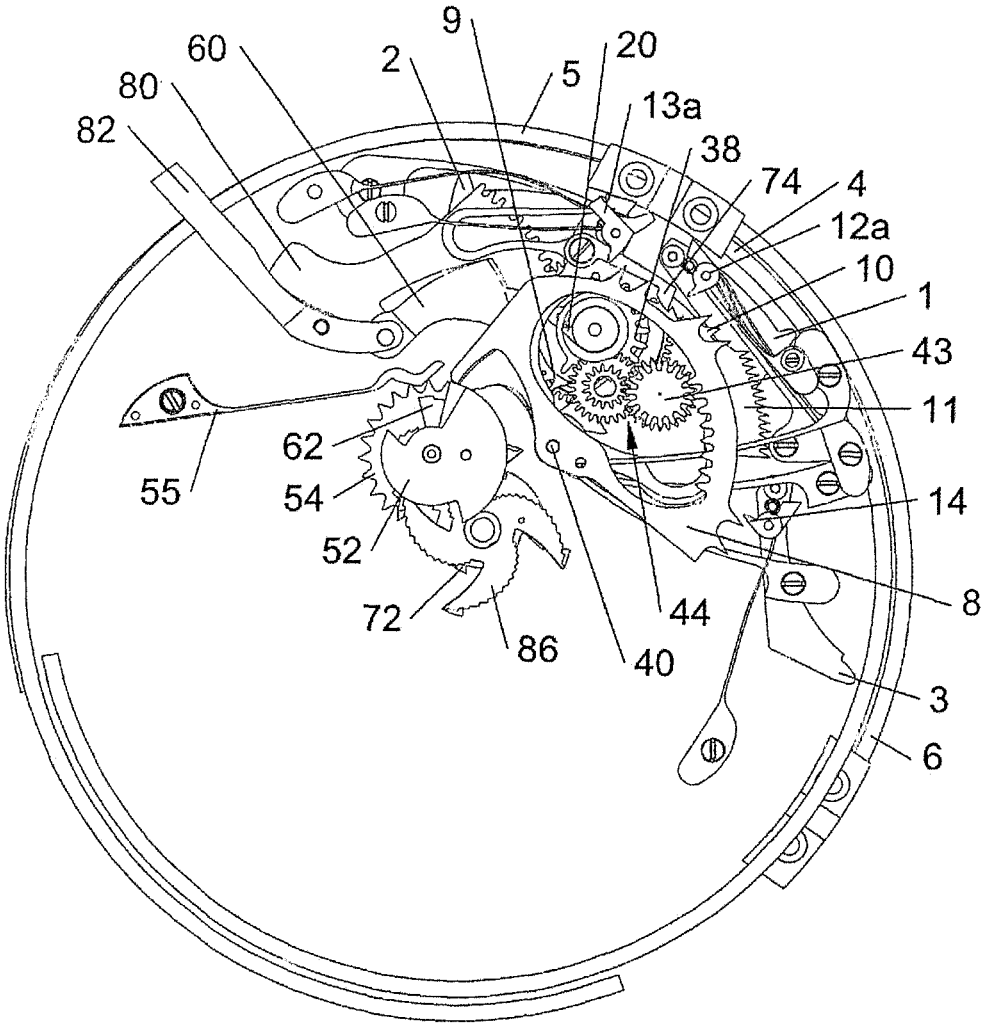
FIG. 1 is an overview of a striking mechanism according to the invention, on the dial side.

The present invention relates to striking mechanism comprising strike-hammers, gongs, each being arranged to produce a sound under the action of the associated hammer, actuators to actuate the associated hammer, a striking control device, and at least one striking driving device arranged to cooperate with the control device.

According to the invention, it further comprises at least one mechanism for striking multiples of n hours, n being an integer greater than or equal to 2 and preferably less than or equal to 10 or 12, for example a mechanism for striking tens of hours, kinematically connected to said striking driving device, said mechanism for striking multiples of n hours being arranged to emit a strike making it possible to identify the multiples of n-hour groups. For example, the mechanism for striking tens of hours is arranged to actuate lifts so as to produce a strike indicating the tens of hours at least from the hour equal to 13:00, and preferably from the hour equal to 10:00 when said control device has been actuated.

The striking control device is arranged to allow several winding possibilities: either the barrel is wound when the striking is triggered (for example in the case of a repetition watch where the striking is triggered by a user using a push-piece, a trigger piece or any other appropriate switching means) or independently from the triggering of the striking (for example by rotating a winding stem in the case of a grand strike).

The number of hammers and gongs may vary depending on the variant embodiments of the invention. It is for example possible to provide two or three hammers and therefore two or three associated gongs to produce two or three different sounds, the sounds being able to be combined with one another to yield strikes characteristic of the tens of hours, units of hours, quarter-hours and minutes. The number of actuators is provided accordingly. It is also possible to provide more gongs and hammers by adapting the construction accordingly. The actuators of the hammers may be integral with the associated hammer or may form two parts with the associated hammer. In the latter case, the actuators may for example be lifts. Furthermore, instead of gongs, it is possible to have bells, or the hammer(s) can act directly on an element of the case such as the bottom or the middle, in order to create a "tapping watch", and instead of hammers, it is possible to provide any other element striking the gongs, bells or an element of the case. These alternatives are not literally part of the invention, but are considered to be obvious alternatives.

The figures only show the parts of the striking mechanism that are essential to the understanding of the invention. For clarification purposes, the common elements known by those skilled in the art have not been included in the drawings.

FIG. 1 provides an overview of the striking mechanism according to the invention. In the illustrated variant, the striking mechanism comprises three hammers 1, 2, 3 and three associated gongs 4, 5, 6, producing different sounds in the sequence identified as ding, dang and dong, respectively. In the illustrated alternative, the hammers are actuated by lifts, but of course any other appropriate hammer actuator may be used.

In the illustrated variant, the mechanism for striking multiples of n hours is a mechanism for striking tens of hours, n then being equal to 10.

According to the invention, the striking mechanism comprises a tens of hours piece 8, as well as in units of hours piece 9, a quarter-hours piece 10 and a minutes piece 11. In the illustrated alternative, the units of hours piece is a ratchet, classically used in repeater striking-works. Of course, any element making it possible to determine the number of blows to be struck can be used, such as a rack, in particular in an automatic-striking watch. The tens of hours piece 8 is intended to cooperate with a first lift for the tens of hours 12*a* to actuate the first hammer 1 associated with the first gong 4 "ding", with a second lift of the tens of hours 13*a* to actuate the second hammer 2 associated with the second gong 5 "dang", and a third lift for the tens of hours 14 to actuate the third hammer 3 associated with the third gong 6 "dong".

The units of hours ratchet 9 is intended to cooperate with an units of hours lift 13*b* mounted on the same staff as the first tens of hours lift 12*a* to actuate the second hammer 2 associated with the second gong 5 "dang".

The quarter-hours piece 10 is intended to cooperate with a first quarter-hours lift 12*b*, mounted on the same axis as the first tens of hours lift 12*a* to actuate the first hammer 1 associated with the first gong 4 "ding" and with a second quarter-hours lift 13*c*, mounted on the same axis as the second tens of hours lift 13*a* and the units of hours lift 13*b*, to actuate the second hammer 2 associated with the second gong 5 "dang".

The minutes piece 11 is intended to cooperate with a minutes lift 12*c* mounted on the same axis as the first tens of hours lift 12*a* and the first quarter-hours lift 12*b* to actuate the first hammer 1 associated with the first gong 4 "ding".

Of course, any other combination of sounds making it possible to establish the different characteristic strike can be used, for example by modifying the position foreseen for the teeth on the racks. Furthermore, depending on the construction needs, any intermediate components may be provided between at least one of the pieces from among the tens of hours piece 8, the units of hours piece 9, the quarter-hours piece 10 and minutes piece 9 on the one hand, and the corresponding lift(s) 12*a*, 12*b*, 13*a*, 13*b*, 13*c*, 14, respectively, on the other hand.

Figure 2:
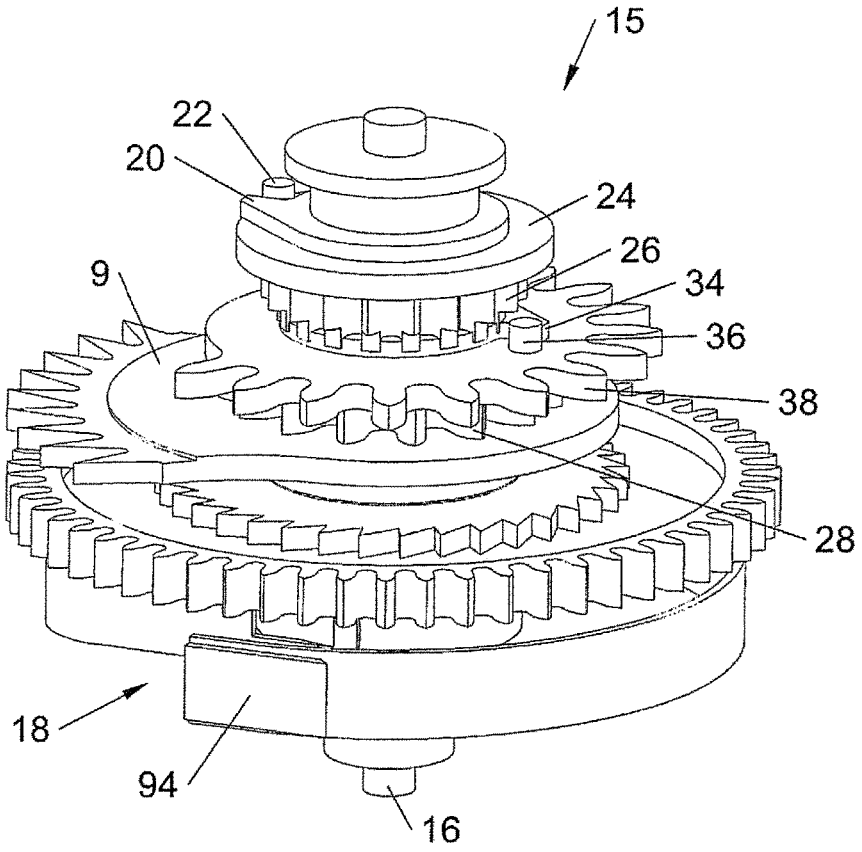
FIGS. 2 and 3 are isometric views of the striking driving device from two different viewing angles.
Figure 3:
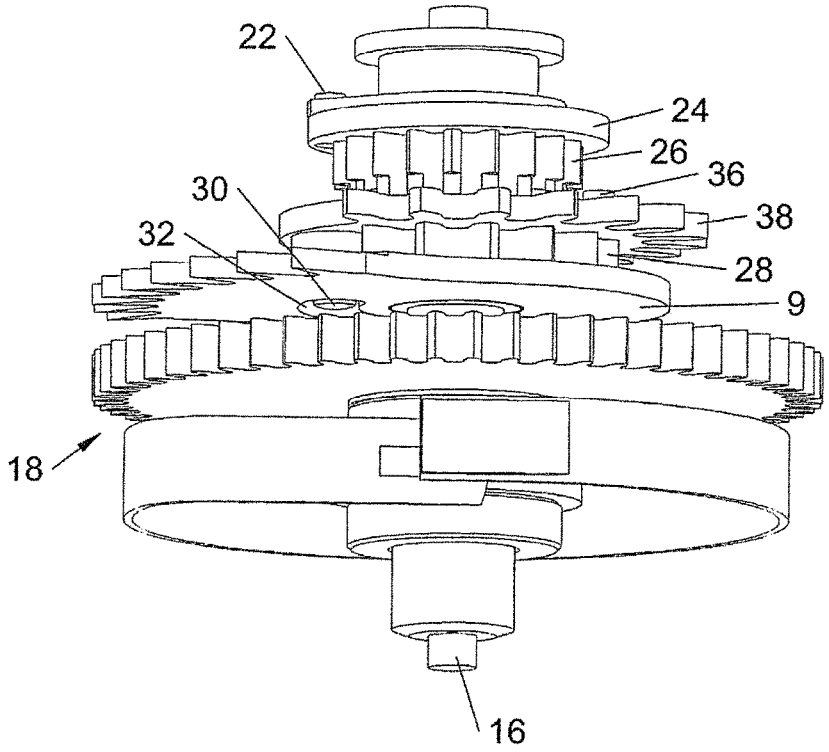

The tens of hour piece 8, the units of hours ratchet 9, the quarter-hours piece 10 and the minutes piece 11 are driven by a striking driving device comprising a single striking driving wheel 15 in the variant illustrated more specifically in FIGS. 2 and 3. Of course, any other means allowing a kinematic transmission may be used.

This striking driving wheel 15 is coaxial to the arbor 16 of the striking barrel 18 constituting the energy source for the striking mechanism. The striking driving wheel 15 comprises a drive finger for groups of multiples of n-hours, and more specifically here tens of hours 12, fitted on a square section of the striking barrel arbor 16, and arranged to cooperate with a tens of hours driving pin 22 carried by a tens of hours driving plate 24 secured to a tens of hours driving pinion 26, kinematically connected to the tens of hours piece 8 as will be described below. The tens of hours driving plate 24 and the tens of hours driving pinion 26 are mounted freely on the arbor 16.

The striking driving wheel 15 also comprises, fitted on a square section of the striking barrel arbor 16, a rack pinion 28 on the one hand arranged to cooperate with the striking control device as will be described below, and on the other hand driving an units of hours driving pin 30 (cf. FIG. 3) arranged to circulate in an oblong 32 provided on the units of hours ratchet 9 that is also mounted on the arbor 16.

The striking driving wheel 15 also comprises a quarter-hours driving finger 34 fitted on a square section of the striking barrel arbor 16 and arranged to cooperate with a quarter-hours driving pin 36 carried by a quarter-hours driving pinion 38, mounted free on the arbor 16, and kinematically connected to the quarter-hours piece 10 as will be described below.

The tens of hours driving finger 20 and the quarter-hours driving finger 34 are arranged offset on the striking barrel arbor 16 to operate as a sequencer to time and regulate the lag between the different strikes.

Figure 8:
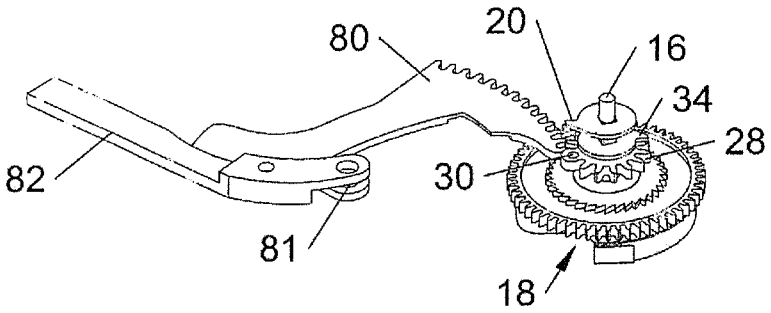
FIG. 8 is an isometric view, on the dial side, of the strike control device and the striking driving device.

In reference to FIG. 8, the striking control device comprises a rack 80 mounted pivoting on a stud 81 and a rack arm 82 arranged to be actuated by a user to trigger the striking, also mounted pivotally on the stud 81. The rack 80 comprises a toothed sector that cooperates with the rack pinion 28 fitted on a square section of the striking barrel arbor 16.

Figure 4:
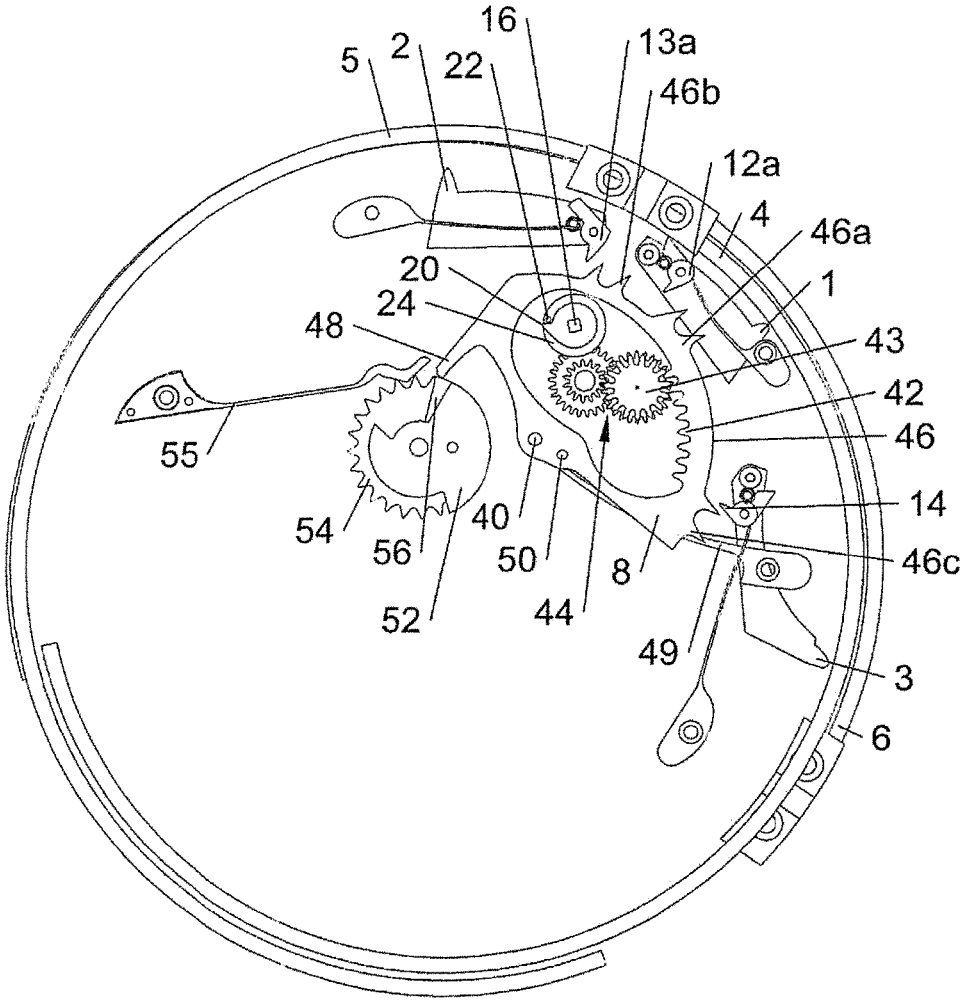
FIG. 4 is a view, on the dial side, of the mechanism for striking tens of hours.

According to the invention, the tens of hours striking mechanism shown in FIG. 4 comprises the tens of hours piece 8 kinematically connected to said striking driving wheel 15 and more particularly to the tens of hours driving pinion 26, driven by the tens of hours driving finger 20 using the tens of hours driving pin 22. To this end, the tens of hours piece 8 has the general form of an arc of a circle and is mounted pivotally around a staff 40 passing through the center of this circle. It includes a circular open inner space allowing the passage of the staff 16 of the striking driving wheel 15, and having, along one of its edges, a circular toothed sector 42, concentric to the tens of hours piece 8, and arranged to cooperate with a wheel 43 of a tens of hours driving gear train 44 cooperating with the tens of hours driving pinion 26 of the striking driving wheel 15.

The tens of hours piece 8 also comprises, on its outer edge, a tens of hours rack 46 comprising three toothed sectors 46*a*, 46*b*, 46*c* of two teeth arranged to respectively actuate the first 12*a*, second 13*a* and third 14 tens of hours lifts to produce the tens of hours striking "ding, dang, dong".

The tens of hours striking mechanism also comprises an element making it possible to obtain information on the tens of hours, for example a tens of hours feeler-spindle 48, arranged to cooperate with a tens of hours cam 52, said tens of hours cam 52 having a periodicity of 24 hours. In a first alternative, as shown here, the tens of hours cam 52 has three steps corresponding to the hours from 0 to 9, from 10 to 19 and from 20 to 24, such that no ding-dang-dong strike is emitted upon each hour between 0 and 9, a single ding-dang-dong strike is emitted upon each hour between 10 and 19 to indicate the tens of hours, and two ding-dang-dong strikes are emitted upon each hour between 20 and 24 to indicate the two tens of hours. In another non-illustrated variant, the tens of hours cam 52 can have three steps corresponding to the hours from 0 to 12, from 13 to 19 and from 20 to 24, such that no ding-dang-dong strike is emitted upon each hour between midnight and noon, a single ding-dang-dong striking is emitted upon each hour between 13:00 and 19:00 to indicate the ten of the hour, and two ding-doing-dong strikes are emitted upon each hour between 20:00 and 24:00 to indicate the two tens of hours. In another non-illustrated variant, the tens of hours cam 52 may have only two steps corresponding to the hours from 01:00 to 12:00, and from 13:00 to 24:00, such that a "dang" strike is emitted upon each hour between 01:00 and 12:00, the number of "dang" being equal to the number of hours to be struck, and a ding-dang-dong+dang×number of additional unitary hours at 13:00 is emitted between 13:00 and 24:00.

The tens of hours feeler-spindle 48 may be integral with the tens of hours piece 8 or may be an attached element mounted securely to said tens of hours piece 8. A spring 49 pressing on a bearing pin 50 is arranged so as to exert, on the tens of hours piece 8, a force tending to bring the tens of hours feeler spindle 48 into contact with the tens of hours cam 52. The spring 49 may be a return element of any kind, including an elastomer return element.

The tens of hours cam 52 is carried by a 24-hour star 54, and driven classically by a pin provided on the quarter-hours cam as will be seen below. A jumper 55 ensures the positioning of the 24-hour star 54.

The tens of hours cam 52 has a tens of hours surprise-piece arranged to prevent the mechanism from indicating two tens of hours again when the day changes and there is a passage to 00:00.

The construction and operation of a surprise-piece are known by those skilled in the art and do not require detailed description.

Figure 5:
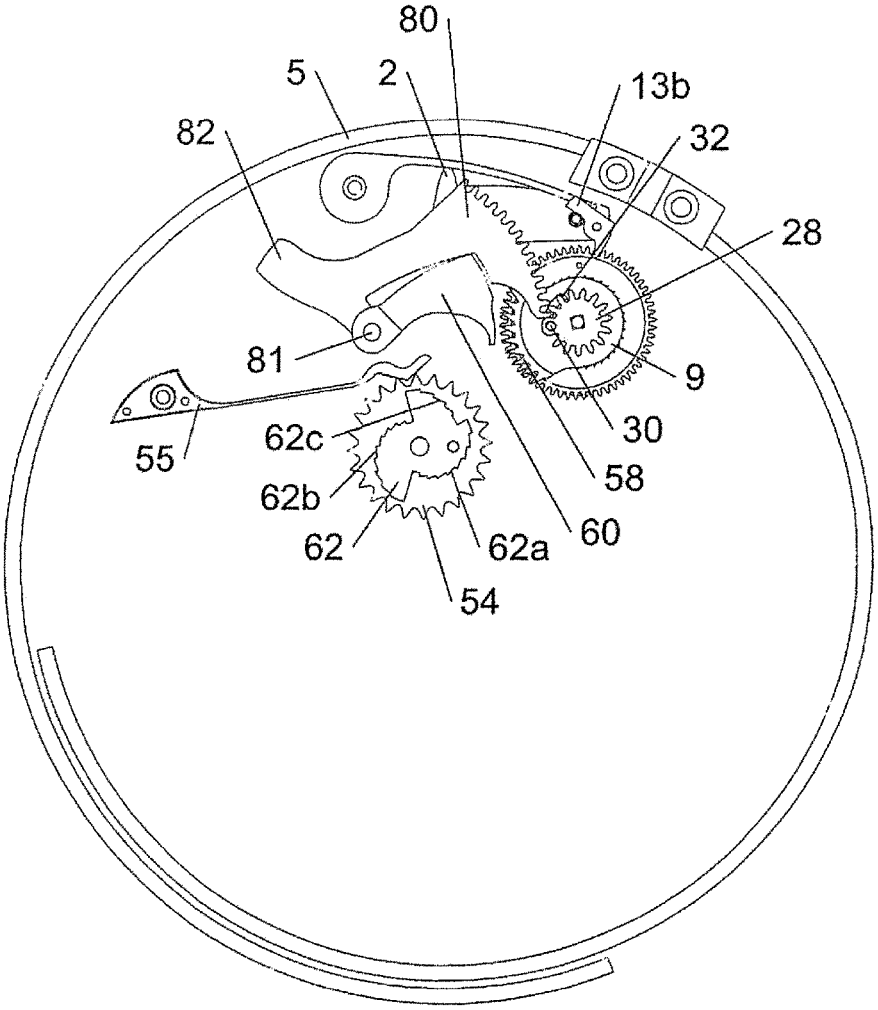
FIG. 5 is a view, on the dial side, of the mechanism for striking units of hours.

The units of hours striking mechanism shown in FIG. 5 is arranged to actuate the lifts so as to produce a strike indicating the units of hours "dang". It comprises the units of hours ratchet 9 kinematically connected to the striking driving wheel 15 and more specifically to the rack pinion 28 via the units of hours driving pin 30. Said units of hours driving pin 30 and the oblong 32 provided on the units of hours ratchet 9 are configured such that the units of hours driving pin 30 abuts in the oblong 32 and drives the units of hours ratchet 9 only after the tens of hour have struck.

The units of hours ratchet 9 also comprises, on its outer edge, an units of hours ratchet 58 comprising a toothed sector with 9 teeth arranged to actuate the units of hours lift 13*b* to produce the striking of the units of hours, i.e., one "clang" per hour to be struck.

The units of hours striking mechanism also comprises an element making it possible to obtain units of hours information, for example an units of hours feeler-spindle 60, mounted pivotally on the same stud 81 as the rack 80 such that the travel of the rack 80 will correspond to the hour to be indicated.

The units of hours feeler-spindle 60 is arranged to cooperate with an units of hours cam 62. Said units of hours cam 62 is secured to the 24-hour star 54 to have a periodicity of 24 hours and has three arms, the first arm 62*a* comprising nine steps corresponding to the units of hours from 01:00 to 09:00, the second arm 62*b* comprising ten steps corresponding to the units of hours from 10:00 to 19:00, the third arm 62*c* comprising five steps corresponding to the units of hours from 20:00 to 24:00.

The striking mechanisms for the tens of hours and units of hours used in the invention may be combined with traditional striking mechanisms for the quarter-hours and minutes known by those skilled in the art.

Figure 6:
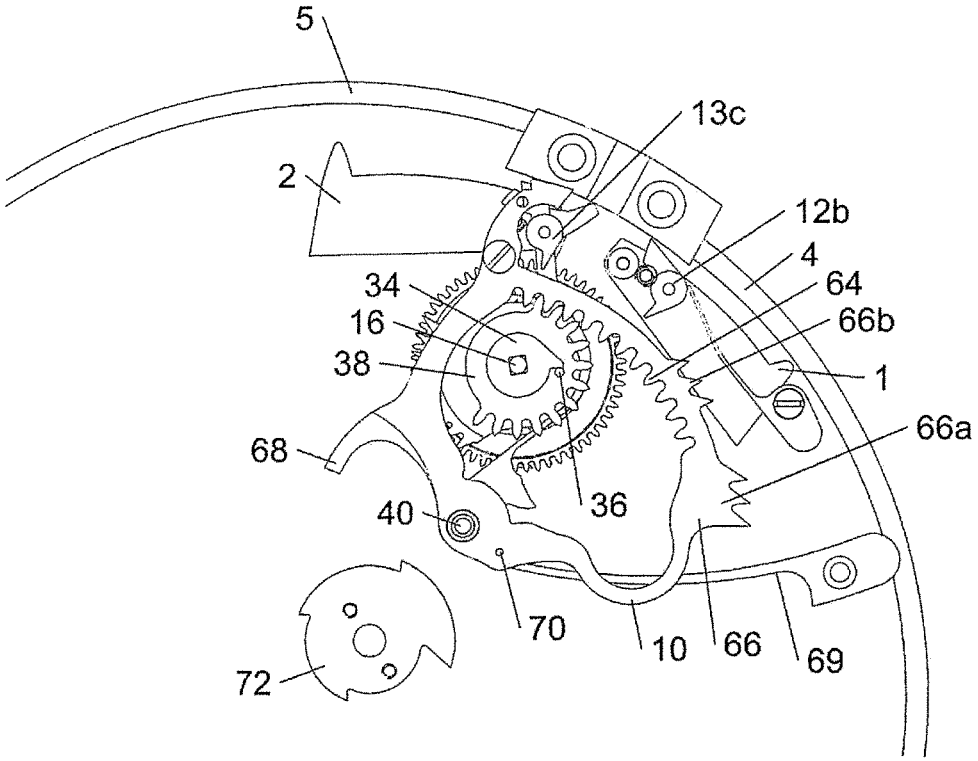
FIG. 6 is a view, on the dial side, of the mechanism for striking quarter-hours.

More specifically in reference to FIG. 6, the quarter-hours striking mechanism is arranged to actuate the lifts so as to produce a striking indicating the quarter-hours, said quarter-hours striking mechanism comprising the quarter-hours piece 10 kinematically connected to said striking driving wheel 15, and more specifically to the quarter-hours driving pinion 38 driven by the quarter-hours driving finger 34 using the quarter-hours driving pin 36. To this end, the quarter-hours piece 10 has the general shape of an arc of a circle, concentric to the arc of circle of the tens of hours piece 8, and is mounted pivotally around the staff 40. It includes a circular open inner space, concentric, allowing the passage of the staff 16 of the striking driving wheel 15 and having, along one of its edges, a circular toothed sector 64 concentric to the quarter-hours piece 10, and arranged to cooperate with the quarter-hours driving pinion 38.

The quarter-hours piece can also comprise, on its outer edge, in a known manner, a quarter-hours rack 66 having a first toothing 66*a*, with three teeth, arranged to actuate the first quarter-hours lift 12*b* and a second toothing 66*b*, with three teeth, arranged to actuate the second quarter-hours lift 13*c* in order to strike the quarter-hours striking on two gongs "ding, dang".

On the side opposite the quarter-hours rack 66, an element is provided making it possible to obtain information on the quarter-hours, for example a quarter-hours feeler-spindle 68, arranged to cooperate with the quarter-hours cam 72, driven classically by a base movement, not shown, in order to obtain information relative to the current time. The quarter-hours feeler-spindle 68 can be in a single piece with the quarter-hours piece 10 or be an attached element mounted securely to said quarter-hours piece 10. A spring 69 pressing on a bearing pin 70 is arranged so as to exert, on the quarter-hours piece 10, a force tending to bring the quarter-hours feeler-spindle 68 into contact with the quarter-hours cam 72. The quarter-hours cam 72 bears a pin (not shown) arranged to advance the 24-hour star 54 by one tooth each hour. These elements are known by those skilled in the art and do not require a detailed description.

Figure 7:
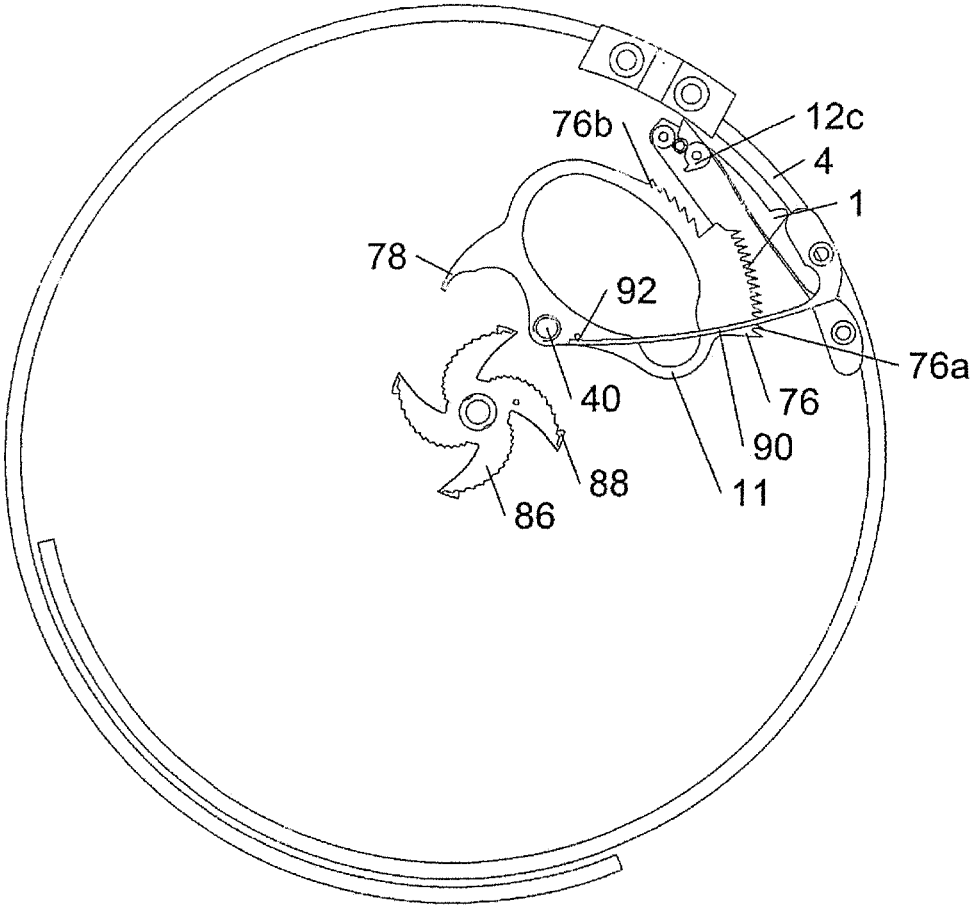
FIG. 7 is a view, on the dial side, of the mechanism for striking minutes.

In reference to FIG. 7, the minutes striking mechanism is arranged to actuate the lifts so as to produce a strike indicating the minutes, said minute striking mechanism comprising the minutes piece 11 kinematically connected to the quarter-hours piece 10 using a minutes driving hook 74 (cf. FIG. 1) carried by the quarter-hours piece 10, as is known by those skilled in the art.

The minutes piece 11 has the general form of an arc of a circle, concentric to the arc of the circle of the tens of hours piece 8 and the quarter-hours piece 10, and is mounted pivotally around the staff 40. Thus, the three tens of hours 8, quarter-hours 10 and minutes 11 pieces are globally concentric and pivot around a same axis 40.

The minutes piece 11 comprises, on its outer edge, in a known manner, a minutes rack 76 comprising a first toothed sector 76*a* with 14 teeth arranged to actuate the minutes lift 12*c* in order to strike the "dang" minutes striking. The minutes rack 76 comprising a second saw-toothed toothed sector 76*b* arranged to cooperate with the minutes driving hook 74, as is known by those skilled in the art.

On the side opposite the minutes rack 76, an element is provided making it possible to obtain minutes information, for example the minutes feeler-spindle 78, arranged to cooperate with a minutes cam 86 driven classically by the base movement, not shown, in order to obtain information relative to the current time. In a known manner, the minutes cam 86 and the quarter-hours cam 72 are coaxial and the minutes cam 86 comprises a surprise-piece 88. The minutes feeler-spindle 78 can be integral with the minutes piece 11 or be an attached element mounted securely to said minutes piece 11. A spring 90 bearing on a bearing pin 92 is arranged so as to exert, on the minutes piece 11, a force tending to bring the minutes feeler-spindle 78 into contact with the minutes cam 86. These elements are known by those skilled in the art and do not require a detailed description.

To make the striking mechanism according to the invention strike, the user lifts the rack arm 82 to actuate the rack 80, which meshes with the rack pinion 28 to wind a striking barrel spring 94 (cf. FIG. 2) until the units of hours feeler-spindle 60 stops on a step of the units of hours cam 62 corresponding to the units of hours to be struck. The units of hours ratchet 9 as well as the tens of hours driving finger 20 and the quarter-hours driving FIG. 34 have traveled the same angle.

In a known manner, the tens of hours, quarter-hours and minutes pieces position themselves based on the hour to be struck by falling on their respective cam, their respective feeler-spindle obtaining corresponding information on said cam.

Once the striking barrel spring is wound, the striking sequence is as follows:

The tens of hours driving finger 20 rotates, drives the tens of hours driving pin 22, carried by the tens of hours driving plate 24, which rotates the tens of hours driving pinion 26, which rotates the tens of hours driving gear train 44 and therefore the wheel 43, which in turn rotates the tens of hours piece 8, which will actuate the tens of hours lift 12*a*, 13*a* and 14. The tens of hours strike "ding, dang, dong" once for the hours comprised between 10:00 and 19:00 and twice for the hours comprised between 20:00 and 24:00.

When the tens of hours have been struck, the units of hours driving pin 30 reaches abutment in the oblong 32 provided on the units of hours ratchet 9 and drives said units of hours ratchet 9, which will actuate the units of hours lift 13*b*. The units of hours strike "dang" once per units of hours to be struck.

When the tens of hours and units of hours have been struck, the quarter-hours driving finger 34 rejoins the quarter-hours driving cam 36 and drives it, which rotates the quarter-hours driving pinion 38, which rotates the quarter-hours piece 10, which will actuate the quarter-hours lifts 12*b* and 13*c*. The quarter-hours strike "ding, dang".

The quarter-hours piece 10 continues its rotation and, via the minutes driving hook 74, pushes the minutes piece 11 via the saw-teeth 76*b*, such that the minutes piece 11 actuates the minutes lift 12*c*. The minutes strike "ding".

Thus, the striking mechanism according to the invention for example makes it possible to strike only 3 blows "ding, dang, dong" at 10:00, 4 blows "ding, dang, dong+dang" at 11:00, and 5 blows "ding, dang, dong+dang, dang" at 12:00, whereas a traditional striking mechanism will strike 10 blows at 10:00, 11 blows at 11:00 and 12 blows at 12:00.

Likewise, the striking mechanism according to the invention also makes it possible to strike only 6 blows, "ding, dang, dong-ding, dang, dong", at 20:00, and 10 blows (ding, dang, dong-ding, dang, dong+dang, dang, dang, dang) at 24:00, whereas a traditional striking mechanism will strike 8 blows at 20:00, and 12 blows at 24:00.

As shown by these examples, the striking time proposed by the mechanism according to the invention is shortened for the hours from 10:00 to 12:00 and from 20:00 to 24:00.

One skilled in the art knows how to adapt the mechanism described for n equals 10 to other values of n. For example, if n is equal to 6, the mechanism will strike "ding, dang, dong" once at 06:00, "ding, dang, dong" twice at 12:00, "ding, dang, dong" three times at 18:00 and "ding, dang, dong" four times at 24:00. It will strike "dang" once per additional hour. Thus, for example, at 07:00, it will strike 4 blows, "ding, dang, dong+dang".

For example, if n is equal 5, the mechanism will strike "ding, dang, dong" one time at 05:00, "ding, dang, dong" two times at 10:00, "ding, dang, dong" three times at 15:00 and "ding, dang, dong" four times at 20:00. It will strike "dang" once per additional hour. Thus, for example at 07:00, it will strike 5 blows "ding, dang, dong+dang, dang".

Figure 9:
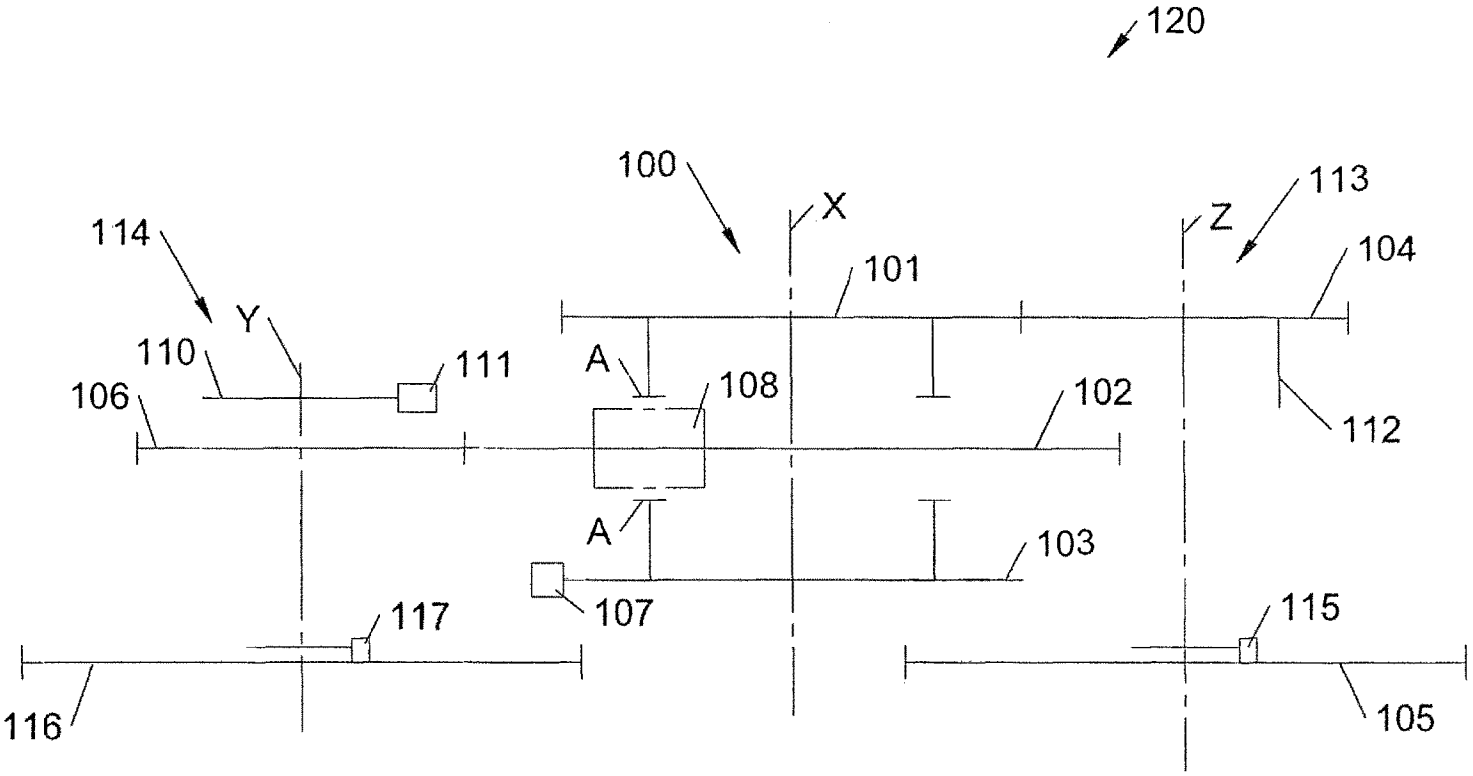
FIGS. 9 and 10 show diagrammatic views of another variant embodiment of the invention.
Figure 10:
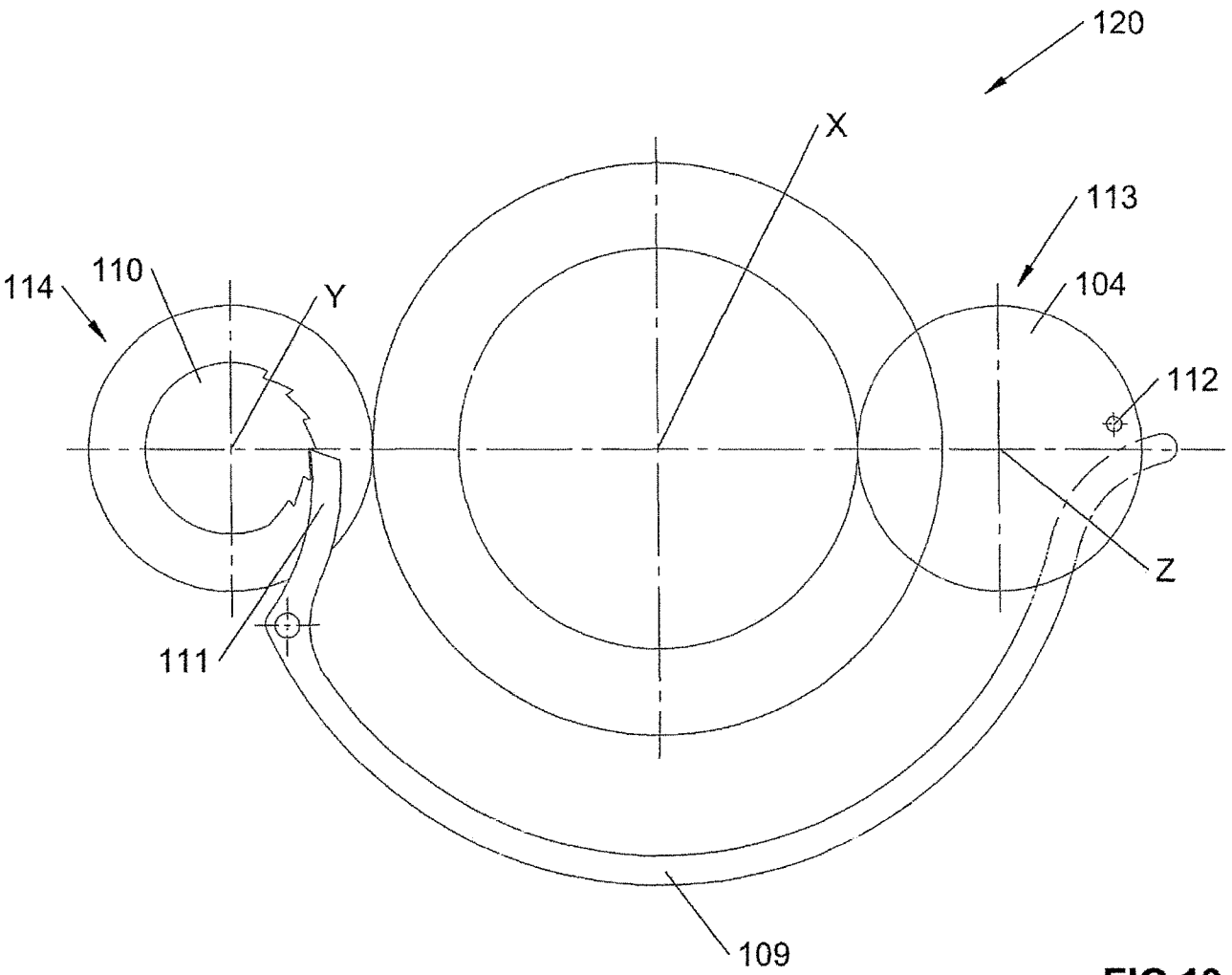

In another variant embodiment of the invention shown in FIGS. 9 and 10, the striking driving device 120 used in the invention is separated into two parts, a first part corresponding to a striking driving wheel for striking multiples of n-hour groups, and in particular tens of hours 113, and a second part corresponding to a striking driving wheel for striking units of hours, quarter-hours and minutes 114. In this case, a differential 100 is provided inserted between the tens of hours striking driving wheel 113 and the units of hours, quarter-hours and minutes striking driving device 114, said differential 100 acting as a sequencer to time and regulate the lag between the different strikes.

The tens of hours striking driving wheel 113 comprises, mounted on a same axis Z, a first driving wheel 105 kinematically connected to a first regulator and bearing, on its upper edge, a ratchet toothing in relation with a click 115, and a first carrier wheel 104 driving a pin 112. The tens of hours striking driving wheel 113 is kinematically connected to the tens of hours piece 8. The axis Z of the tens of hours striking driving wheel 113 corresponds to the striking barrel axis 18.

The units of hours, quarter-hours and minutes striking driving wheel 114 comprises, mounted on a same axis Y, a second driving wheel 116 kinematically connected to the rack using a pinion secured to said axis, a second carrier wheel 106, and a partially-toothed ratchet 110 secured to the axis Y and in relation with a click 111. The second driving wheel 116 is kinematically connected to a second regulator. It carries, on its upper edge, a ratchet toothing in relation with a click 117. The striking driving wheel of the units of hours, quarter-hours and minutes 114 is kinematically connected to the units of hours ratchet 9 and the quarter-hours 10 and minutes 11 pieces.

The differential 100 comprises, mounted on the same axis X, a first wheel 101 meshing with the first driving wheel 104, a second wheel 102 meshing with the second driving wheel 106 and a ratchet 103 in relation with a click 107. The second wheel 102 carries a satellite pinion 108 arranged to mesh with a toothing A provided on the first wheel 101 and on the ratchet 103.

A lever 109 is provided to free the click 111 from the partially-toothed ratchet 110 secured to the staff Y of the units of hours, quarter-hours and minutes striking driving wheel 114 when it is lifted by the pin 112 carried by the first driving wheel 104 of the tens of hours striking driving wheel 113 when the tens of hours have finished striking.

According to this variant, during winding, the ratchet of the differential 103 is blocked by its click 107, such that the user, by actuating the arm of the rack, pivots the rack, which drives the staff Y of the striking driving wheel of the units of hours, quarter-hours and minutes 114, and therefore the second driving wheel 106 of the striking driving wheel of the units of hours, quarter-hours and minutes 114, the second wheel 102 of the differential, the first wheel 101 of the differential and the first wheel 104 of the tens of hours striking driving wheel 113 rotate, to wind the striking barrel spring.

When the striking begins, the second driving wheel 106 of the striking driving wheel for the units of hours, quarter-hours and minutes 114 is blocked by the click 111 of the partially-toothed ratchet 110 and the click 107 of the ratchet of the differential 103 unclicks. Thus, the first wheel 104 of the tens of hours striking driving wheel 113, the first wheel 101 of the differential 100, the planetary pinion 108 and the ratchet 103 of the differential rotate, allowing the activation of the tens of hours piece 8, and the striking of the tens of hours as described above. When the tens of hours are struck, the pin 112 carried by the first driving wheel 104 of the tens of hours striking driving wheel 113 lifts the lever 109, which frees the click 111 from the partially-toothed ratchet 110 secured to the staff Y of the striking driving wheel of the units of hours, quarter-hours and minutes 114. The click 107 of the differential blocks the ratchet 103 of the differential, such that the first wheel 104 of the tens of hours striking driving wheel 113, the first wheel 101 of the differential, the second wheel 102 of the differential and the second wheel 106 of the striking driving wheel for the units of hours, quarter-hours and minutes 114 rotate, allowing the activation of the ratchet of the units of hours 9 and the quarter-hours 10 and minutes 11 pieces, and the striking of the units of hours, quarter-hours and minutes, as described above.

The mechanism according to the invention makes it possible to strike the 24 hours in a day, and is not limited to 12 hours as is the case in traditional repetition striking-works. It therefore allows the user to differentiate "noon" from "midnight", and the hours of the morning from those of the afternoon.

The striking mechanism according to the invention may be used for repetition striking-work and for automatic-striking mechanisms (for example hours, hour and a halves, petite or grand strikes). These striking-works can use racks or ratchets to inform the hammers of the number of blow to be struck, in particular for the hours piece.

The striking mechanism according to the invention can also be used to indicate the true solar time by striking. It can also be used in a travel striking timepiece, the striking function being connected to a second time zone chosen by the user. For example, the "home time" can be indicated by hands, and the hour in the second time zone can be known by activating the striking-work, which will strike based on the hour of the second time zone. Furthermore, the mechanism can be used to strike a timed time counting the n hours, or in a countdown watch counting n hours, inter alia. In each of the latter cases, the striking mechanism can be triggered at the user's request or automatically, for example upon each new n-hour group incremented or decremented, as applicable.

The invention claimed is:

1. Striking mechanism comprising strike-hammers, gongs, each being arranged to produce a sound under the action of an associated hammer, actuators to actuate the associated hammer, a striking control device, and at least one striking driving device arranged to cooperate with said control device, wherein the striking mechanism further comprises at least one mechanism for striking multiples of n hours, n being equal to ten, kinematically connected to said striking driving device, said mechanism for striking multiples of n hours arranged to actuate hammers to strike the tens of hours according to a specific strike at least from the hour equal to 10:00 or 13:00 when said control device has been actuated.

2. Striking mechanism according to claim 1, wherein said mechanism for striking tens of hours comprises at least one tens of hours piece kinematically connected to said striking driving device and comprising a tens of hours rack arranged to actuate hammers to strike the tens of hours and a tens of hours feeler-spindle arranged to cooperate with a tens of hours cam, said tens of hours cam having a periodicity of 24 hours and having at least two steps.

3. Striking mechanism according to claim 2, wherein the tens of hours cam has three steps corresponding to the hours of 0 to 12, 13 to 19, and 20 to 24.

4. Striking mechanism according to claim 2, wherein the tens of hours cam has three steps corresponding to the hours of 0 to 9, 10 to 19, and 20 to 24.

5. Striking mechanism according to claim 1, wherein said mechanism for striking tens of hours comprises at least one tens of hours piece kinematically connected to said striking driving device and comprising a tens of hours rack arranged to actuate hammers to strike the tens of hours and a tens of hours feeler-spindle arranged to cooperate with a tens of hours cam, said tens of hours cam having a periodicity of 24 hours and having at least two steps.

6. Striking mechanism according to claim 5, wherein the tens of hours cam has three steps corresponding to the hours of 0 to 12, 13 to 19, and 20 to 24.

7. Striking mechanism according to claim 5, wherein the tens of hours cam has three steps corresponding to the hours of 0 to 9, 10 to 19, and 20 to 24.

8. Striking mechanism according to claim 1, wherein said striking mechanism further comprises a mechanism for striking units of hours arranged to actuate hammers to strike the units of hours according to a different strike to the strike of the multiples of n hours, said units of hours striking mechanism comprising an units of hours piece kinematically connected to said striking driving device and arranged to actuate the hammers to strike the units of hours, and an units of hours feeler-spindle arranged to cooperate with an units of hours cam, said units of hours cam having a periodicity of 24 hours and having three arms, the first arm comprising nine steps corresponding to units of hours from 01:00 to 09:00, the second arm comprising 10 steps corresponding to the units of hours from 10:00 to 19:00, and the third arm comprising five steps corresponding to the units of hours from 20:00 to 24:00.

9. Striking mechanism according to claim 1, wherein the striking driving device comprises a sequencer to time and regulate the lag between the striking of the multiples of n hours, the units of hours, the quarter-hours and the minutes.

10. Striking mechanism according to claim 9, wherein the striking driving device comprises a single striking driving wheel, and in that the sequencer comprising a driving finger for the multiples of n-hour groups and a driving finger for the quarter-hours carried in an offset manner by said striking driving wheel.

11. Striking mechanism according to claim 9, wherein the striking driving device comprises a striking driving wheel for the multiples of n-hour groups, and a striking driving wheel for the units of hours, quarter-hours and minutes, and in that the sequencer comprises a differential inserted between said striking driving wheel of the multiples of n-hour groups and the striking driving wheel of the units of hours, quarter-hours and minutes.

12. Striking mechanism according to claim 11, wherein said multiples of n-hour groups represent tens of hours.

13. Timepiece comprising a striking mechanism according to claim 1.

* * * * *